United States Patent [19]

Kohl et al.

[11] Patent Number: 4,922,572

[45] Date of Patent: May 8, 1990

[54] DRIVABLE AUTOMATIC FLOOR CLEANING MACHINE

[75] Inventors: Albert Kohl, Solothurn; Léon Seilaz, Koppigen, both of Switzerland

[73] Assignee: Henkel Kommanditgesellschaft auf Aktein, Duesseldorf, Fed. Rep. of Germany

[21] Appl. No.: 167,053

[22] Filed: Mar. 11, 1988

[30] Foreign Application Priority Data

Mar. 13, 1987 [DE] Fed. Rep. of Germany ..... 3708086

[51] Int. Cl.[5] ..... A47L 11/02; A47L 11/29; A47L 11/03

[52] U.S. Cl. ..... 15/320; 15/321; 15/353

[58] Field of Search ..... 15/320, 321, 353

[56] References Cited

U.S. PATENT DOCUMENTS

| | | | |
|---|---|---|---|
| 3,443,272 | 5/1969 | Trelc et al. | 15/29 |
| 3,909,197 | 9/1975 | Cremers | 15/321 X |
| 4,067,668 | 1/1978 | Nimell | 417/492 |
| 4,196,492 | 4/1980 | Johnson et al. | 15/353 X |
| 4,207,649 | 6/1980 | Bates | 15/321 X |
| 4,210,978 | 7/1980 | Johnson et al. | 15/320 |
| 4,254,412 | 3/1981 | Togneri | 340/506 X |
| 4,311,586 | 1/1982 | Baldwin et al. | 210/101 |
| 4,348,783 | 9/1982 | Swanson et al. | 15/353 X |
| 4,667,364 | 5/1987 | Meili | 15/353 X |
| 4,722,675 | 2/1988 | Albarda | 417/509 |

FOREIGN PATENT DOCUMENTS

| | | |
|---|---|---|
| 1112815 | 8/1961 | Fed. Rep. of Germany . |
| 8617171 | 9/1986 | Fed. Rep. of Germany . |

*Primary Examiner*—Stephen Marcus
*Assistant Examiner*—Christine A. Peterson
*Attorney, Agent, or Firm*—Ernest G. Szoke; Wayne C. Jaeschke

[57] ABSTRACT

A drivable floor cleaning machine with integrated fresh liquid compartment (10) and dirty liquid compartment (11) and with a cleaning rotor (19) designed to be supplied with cleaning liquid from the fresh liquid compartment (10). Regulation of the liquid feed to the rotor, with constant observation of the available volume of the liquid for supply to the cleaning rotor (19) are provided. Liquid feed regulation is controlled by an alternating current oscillating piston pump (31) (FIG. 8).

8 Claims, 3 Drawing Sheets

DRIVABLE AUTOMATIC FLOOR CLEANING MACHINE

BACKGROUND OF THE INVENTION

The present invention relates to a drivable automatic floor cleaning machine having integrated fresh liquid and dirty liquid compartments, a cleaning rotor mounted in position to be supplied in regulated manner with cleaning liquid from the fresh liquid compartment, at least one floor suction nozzle for returning used cleaning liquid to the dirty liquid compartment, and a control handle containing operating control elements.

An automatic floor cleaning machine of this type, currently in use, has at its underside a rotor receptacle adapted to be coupled with an accessory part, in particular a brush or a driven plate with pad, by laying the accessory part on the floor and driving the appliance over the accessory part, or by placing the appliance thereon. Merely a brief starting of the motor associated with the rotor is then required in order to detent or couple the accessory part.

In operation, cleaning liquid from a separate fresh water tank is sprayed by way of the rotor onto the floor to be treated. At the same time, scrubbing is done by the rotor. The dirty water still remaining on the floor after the scrubbing operation is sucked up again and returned to a dirty water tank with the aid of beam-like water-suction nozzle following behind the rotor during the forward progress of the automatic machine so that the floor can be scrubbed thoroughly and at the same time be wiped dry in a certain sense, i.e., by suction-removal of the dirty water, in one continuous operation.

The amount of fresh liquid fed to the cleaning rotor is variable, depending upon the amount of dirt to be eliminated. In the case of known operating appliances, the liquid fed to the rotor is opened by an electrical valve and subsequently regulated with the aid of a manual valve. This manual valve must always be mounted in the region underneath the liquid tank, in proximity to the bottom. Therefore, it is difficult to operate. A further problem is due to the fact that the fresh liquid pressure depends on the quantity of the fresh liquid reserve. This problem is magnified when a flexible liquid tank is used, for example, one in which the intermediate wall between fresh liquid and dirty liquid is constructed as a tight membrane or water sack.

SUMMARY OF THE INVENTION

An object of the present invention is to create a conveniently-operable regulation of the quantity of fresh liquid fed for the initially named automatic cleaning machine, which regulation is applicable also on the use of the flexible tank. The solution according to the invention is characterized by the use of an alternating current oscillating piston pump for the regulation of the fresh liquid fed to the cleaning rotor. Preferably, the conveying performance is regulated by an electronic system or a pulse generator with about ten stages connected in front of the oscillating piston pump.

The present invention makes it possible to relocate the control means for the fresh liquid fed into the control handle of the automatic machine or into the fittings tunnel thereof. The operation can thus take place without physical strain and at the same time with greater precision because of the better possibility of observing the floor during regulation. For example, two keys, namely a plus key and a minus key, may be integrated in the control handle or in the fittings panel of the automatic machine for the regulation of the fresh liquid quantity.

It is also advantageous for the operation of the automatic machine according to the invention to be able to monitor at all times the volume of fresh liquid remaining for disposal. Preferably, probes for the instantaneous detection of the fresh liquid volume are provided for this purpose within the fresh liquid compartment of the tank. In particular, these probes are designed to be supplied with alternating voltage by way of an integrated switching circuit (IC) which becomes conductive on immersion (of the probe) into an electroconductive fresh liquid. The integrated circuit shall thus be conductive when and for as long as the probe is covered by the particular liquid. In this manner, the liquid volume can be indicated, for example by luminescent diodes, pointer instruments, warning lights or the like.

It is understood under the phrase "fresh liquid" in the present context is a mixture of fresh water and cleaning concentrate. "Dirty liquid" is fresh liquid sucked up from the floor. For the sake of simplicity, fresh water and dirty water, respectively, are also referred to.

THE DRAWINGS

Details of the invention are explained by reference to the schematic drawing of examples of embodiments of the invention.

Figure 1:
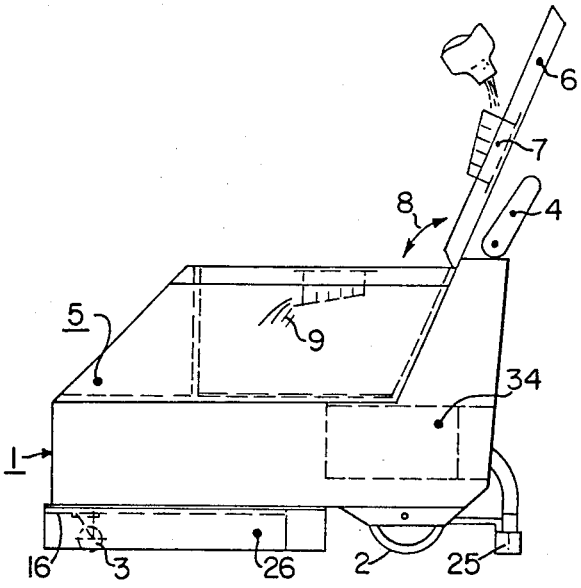
FIG. 1 is a side elevation, partially in section, of a drivable automatic floor cleaning machine.
Figure 3:
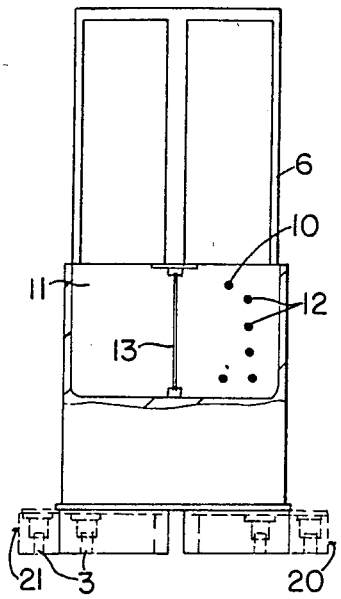
Figure 4:
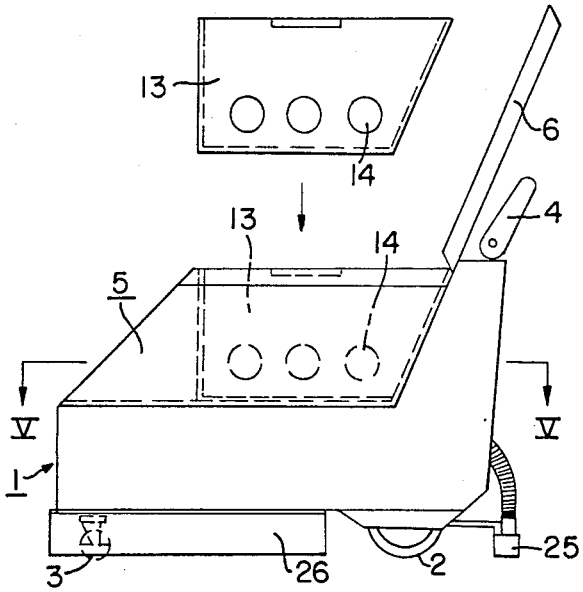
Figure 5:
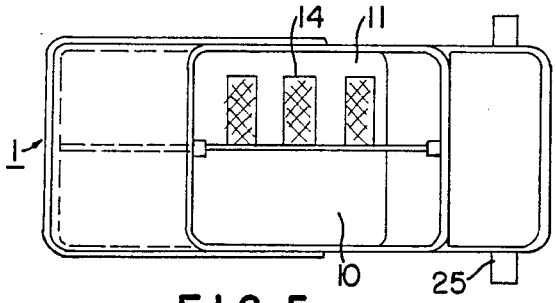
Figure 6:
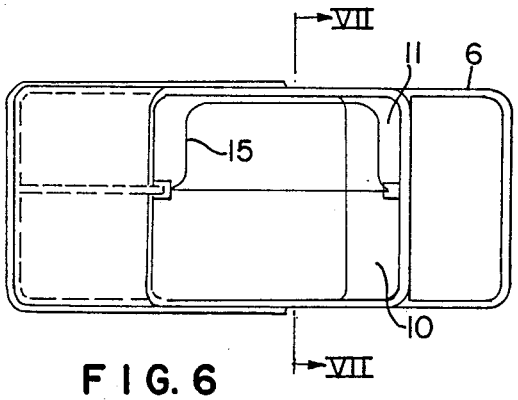
Figure 7:
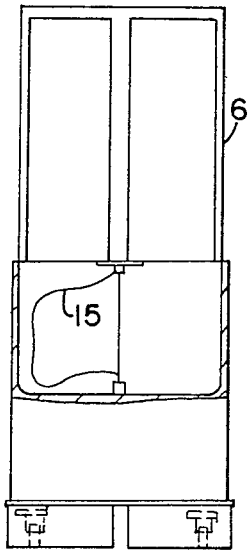

FIG. 3, partially in section, is an elevation of the automatic machine of FIG. 1 from the left;

FIG. 4, partially in section, is a side elevation of the drivable automatic floor cleaning machine with an exchangeable, mechanically solid intermediate wall;

FIG. 5 is a section along the line V—V of FIG. 4;

FIG. 6 is a section according to FIG. 5 illustrating a flexible intermediate wall constructed as membrane or water sack;

FIG. 7 is a section along the line VII—VII of FIG. 6; and

Figure 8:
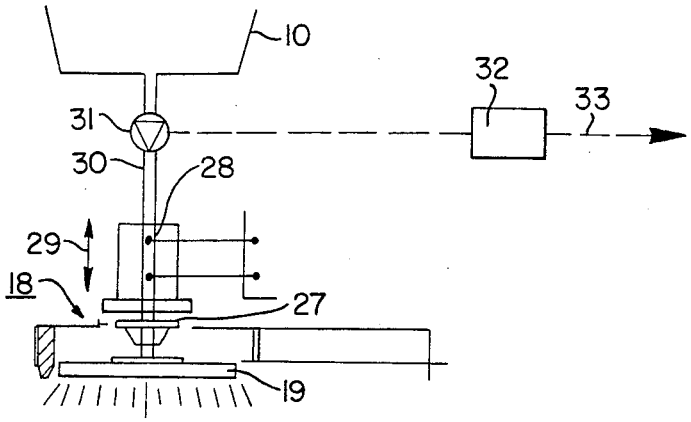

FIG. 8 is an illustration of the coupling region of an appliance entraining member and cleaning rotor.

DESCRIPTION OF PREFERRED EMBODIMENTS

Figure 2:
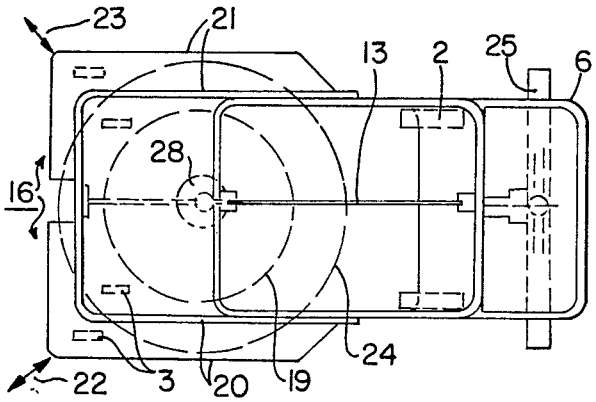
FIG. 2 is a projection of the automatic machine according to FIG. 1 on the floor with two positions of the resettable machine frame.

FIGS. 1 to 3 show a drivable automatic floor cleaning machine in three different views, projections or sections. The automatic machine consists of a carriage, designated generally as 1, having drive rollers 2 and support rollers 3 as well as control handle 4 with operating panel. A liquid tank designated generally as 5 takes up a large part of the interior of the carriage 1. This tank possesses a lid 6 with a metering container 7 fastened thereat and displaying a scale. The scale indicates the desired mixture ratio of fresh water to cleaning concentrate. With the lid 6 open, the metering container 7 can be filled according to the given mixture ratio. Through closing of the lid 6 in closing direction 8, the contents 9 of the metering container 7 empty into the liquid tank 5.

The liquid tank 5 consists of a fresh water compartment 10 and a dirty water compartment 11. In the illustrated embodiment, several probes 12 are provided for the detection and indication of the liquid volume present in the fresh water compartment 10. By an integrated switching circuit or IC, the probes can be acted on by an alternating voltage (direct current is not used in order to prevent a galvanic erosion of the probes). The IC becomes conductive as soon as and for as long as the probes are covered by a liquid. The amount of liquid present can be indicated by luminescent diodes, pointer instruments, warning lights or the like.

The fresh water compartment 10 and the dirty water compartment 11 are separated each from the other by an intermediate wall 13. The intermediate wall can, as in FIGS. 2 or 3, represent a solid separating wall between both the compartments 10 and 11. For adaptation to the respective quantity ratio, it can also be arranged to be laterally displaceable or resettable for the separation of the compartments 10 and 11. A solid intermediate wall 13 with filter cartridges 14 inserted therein is illustrated schematically in FIGS. 4 and 5. In place of a fixed intermediate wall 13, a flexible intermediate wall 15 can be used, as shown by FIGS. 6 and 7, for the separation of the fresh water compartment 10 from the dirty water compartment 11.

FIGS. 1 and 2 illustrate a resettable machine frame 16 fastened at the underside of the carriage 1 which frame 16 consists of at least two frame parts 20 and 21 which are supported to be pushed apart or one into the other radially with respect to the cleaning rotor 19 engaged in a receptacle 18 on the underside 17 of the carriage 1. The frame parts 20 and 21 are thus radially displaceable and adjustable relative to the receptacle 18 in the arrow directions 22 and 23, respectively, illustrated in FIG. 2. Through such a resetting of the machine frame 16, it is possible to replace a rotor 19 of smaller diameter by a rotor 24 of larger diameter and to adapt the machine space or washing space, which is at least partially enclosed by the machine frame 16, in and under the cleaning rotor 19 and 24, respectively, as well as possible to the diameter of the rotor.

A suction nozzle 25, which can have the form of a wide pad or suction beam as shown most clearly in FIG. 2, is provided according to FIGS. 1 and 2 at the rear side of the automatic machine, i.e., on the side of the drive rollers 2 remote from the cleaning rotor 19 or 24. Suction nozzle 25 is connected to the dirty water compartment 11 to suck dirty water from the floor and return it to the compartment 11. As shown by FIGS. 2 and 4, a curtain 26 is suspended from the machine frame 16 on the front side of the automatic machine, opposite the suction nozzle 25, as well as at the sides of the automatic machine laterally of the rotor. This substantially prevents water from flowing, at least in the case of an even floor, against the sides screened by the machine frame 16 or curtain 26.

An example of an embodiment of the rotor exchange system is described by reference to FIG. 8. The engagement of a cleaning rotor 19, for example constructed as a brush, into the receptacle, designated generally by 18, of the automatic washing machine, is accomplished by first raising a coupling comprising an entraining star 27 with motor 28 in arrow direction 29. Thereupon, the rotor 19 is pushed under the machine until it abuts at a centering spigot for preliminary centering. Finally, the motor 28 is lowered in arrow direction 29 in such a manner that the entraining star 27 enters into an entraining receptacle of the rotor 19 and detents there.

The fresh water feed, for example, a connecting duct 30 through the motor 28 between the fresh water compartment 10 and the cleaning rotor 19, is important in this connection. This connecting duct 13 contains an alternating current oscillating piston pump 31 for the regulation of the fresh water fed to the rotor 19. An electronic pulse generator system 32, which is connected by a line 33 on the one hand with an operating key arrangement (not shown) in the fittings panel or the like and on the other hand with the oscillating piston pump 31, serves for the control of the oscillating piston pump 31. Preferably, the electronic system 32 has a control connection coming out from the probes 12 according to FIG. 3 as well as a further control connection (not shown) to the motor 28 in order to avoid a running-dry of the cleaning rotor 19 in the case of lack of liquid in the compartment 10.

The drivable automatic floor cleaning machine can selectably be powered by a battery or directly from the mains. In the case of battery operation, for example at 24 volts, a set of ready wired batteries is pushed into a battery compartment 34 of the machine, shown in FIG. 1, and connected to the machine network. In the case of mains operation (220 volts alternating current) of an automatic machine also designed for the battery operation, a mains part containing a transformer and a rectifier is pushed into the battery compartment 34 and connected with the machine network.

It is to be understood that the above described embodiments of the invention are illustrative only and that modifications throughout may occur to those skilled in the art. Accordingly, this invention is not to be regarded as limited to the embodiments disclosed herein, but is to be limited as defined by the appended claims.

We claim:

1. In a drivable automatic floor cleaning machine have a drive motor, drive wheels associated with said drive motor, integrated fresh liquid and dirty liquid compartments, a cleaning rotor rotatable by said drive motor and designed to be supplied with a regulated supply of liquid from the fresh liquid compartment, and at least one suction nozzle for withdrawing dirty liquid into the dirty liquid compartment, and a control handle containing operating elements, the improvement which comprises an alternating current oscillating piston pump which regulates the supply of the fresh liquid from the fresh liquid compartment to the cleaning rotor, an adjustable electrical control means between said piston pump and said control handle for permitting the operator to adjust the speed of said piston pump at said control handle, independently of the speed of said drive motor, to regulate the volume of fresh liquid supplied to said rotor during operation of said machine, said control means including an electronic pulse generator having a plurality of regulating stages, said pulse generator being connected to said oscillating piston pump for controlling said pump, said control means further including a plus key and a minus key integrated in said control handle, for permitting an operator to regulate said oscillating piston pump, and a dust connected from said pump through the center of said motor and the center of said rotor, for delivering fresh liquid to the center of said brush.

2. Automatic machine according to claim 1 further comprising at least one probe located within the fresh water compartment and adapted to automatically indicate the volume of fresh liquid present within said compartment.

3. Automatic machine according to claim 2 in which the probes are connected to an integrated circuit which becomes conductive of alternating current of immersion of the probes in an adequate volume of fresh liquid within the fresh liquid compartment.

4. Automatic machine according to claim 3 in which indicating means is associated with the integrated circuit and the probes to provide a visual indication of the volume of fresh liquid present within the fresh liquid compartment.

5. In a drivable automatic floor cleaning machine having a drive motor, drive wheels associated with said drive motor, integrated fresh liquid and dirty liquid compartments, a cleaning rotor rotatable by said drive motor and designed to be supplied with a regulated supply of liquid from the fresh liquid compartment, and at least one suction nozzle for withdrawing dirty liquid into the dirty liquid compartment, and a control handle containing operating elements, the improvement which comprises an alternating current oscillating piston pump which regulates the supply of the fresh liquid from the fresh liquid compartment to the cleaning rotor, an adjustable electrical control means between said piston pump and said control handle for permitting the operator to adjust the speed of said piston pump at said control handle, independently of the speed of said drive motor, to regulate the volume of fresh liquid supplied to said rotor during operation of said machine, and a duct connected from said oscillating pump through the center of said drive motor to the center of said rotor, for delivering fresh water to said rotor.

6. Automatic machine according to claim 4, wherein said indicating means includes luminescent diodes.

7. Automatic machine according to claim 4, wherein said indicating means includes pointer instruments.

8. Automatic machine according to claim 4, wherein said indicating means includes warning lights.

* * * * *

UNITED STATES PATENT AND TRADEMARK OFFICE

CERTIFICATE OF CORRECTION

PATENT NO. : 4,922,572

DATED : May 8, 1990

INVENTOR(S) : Albert Kohl et al.

It is certified that error appears in the above-identified patent and that said Letters Patent is hereby corrected as shown below:

At Claim 1, Column 4, line 57, "dust" should read --duct--.

Signed and Sealed this

Twenty-fifth Day of June, 1991

*Attest:*

HARRY F. MANBECK, JR.

*Attesting Officer*

*Commissioner of Patents and Trademarks*